United States Patent [19]

Barclay et al.

[11] 4,196,062

[45] Apr. 1, 1980

[54] METHOD OF BRIGHTENING ELECTRODEPOSITED CHROMIUM

[75] Inventors: Donald J. Barclay; James M. Vigar, both of Olivers Battery, England

[73] Assignee: International Business Machines Corporation, Armonk, N.Y.

[21] Appl. No.: 962,279

[22] Filed: Nov. 20, 1978

[30] Foreign Application Priority Data

Apr. 6, 1978 [GB] United Kingdom ..... 13459/78

[51] Int. Cl.[2] ..... C25D 5/52

[52] U.S. Cl. ..... 204/36; 134/2

[58] Field of Search ..... 204/35 R, 36; 134/2, 134/3, 41, 42

[56] References Cited

U.S. PATENT DOCUMENTS

| | | | |
|---|---|---|---|
| 3,216,912 | 11/1965 | Shoemaker | 204/35 R |
| 3,573,984 | 4/1971 | Shah | 134/2 |
| 3,755,091 | 8/1973 | Austin | 204/35 R |
| 3,966,570 | 6/1976 | Yamagishi et al. | 204/35 R |

*Primary Examiner*—John H. Mack
*Assistant Examiner*—William Leader
*Attorney, Agent, or Firm*—William N. Hogg; Francis A. Sirr

[57] ABSTRACT

A method for brightening an electroplated chromium deposit wherein the deposited chromium is contacted with a solution having a constituent capable of forming complexes with chromium hydroxide species and of detaching the complexes so formed from the surface of an electroplated deposit. Preferably the solution is an alkaline ferricyanide solution or a solution of sodium dichromate in sulphuric acid.

5 Claims, No Drawings

METHOD OF BRIGHTENING ELECTRODEPOSITED CHROMIUM

BACKGROUND OF THE INVENTION

The present invention relates to a bright dip for electroplated chromium and more particularly for chromium electroplated from an electroplating solution having a chromium (III) thiocyanate complex as the source of chromium.

Electroplating solutions in which the source of chromium is a chromium (III) thiocyanate complex are described and claimed in U.S. Pat. No. 4,062,727 issued Dec. 13, 1977 entitled "Electro Deposition of Chromium" and in the specifications of pending United States patent applications Ser. No. 833,635 filed Sept. 15, 1977 entitled "Method and Composition for Electroplating Chromium and its Alloys and the Method of Manufacture of the Composition," and Ser. No. 913,639 filed June 8, 1978 entitled "Method of and Solution for Electroplating Chromium and Chromium Alloys and Method of Making the Solution," and Ser. No. 913,973 filed June 8, 1978 entitled "Electroplating Chromium and its Alloys."

Chromium plated from solutions containing chromium (III) thiocyanate complexes described in the above mentioned patents and applications tend to have a richer color than chromium plated from hexavalent chromic acid plating solutions.

It is believed that the color of the deposited chromium depends on at least two factors. Firstly, the inclusion of a percentage of sulphur forming an alloy with the chromium in the deposit, and secondly the formation of a surface film during deposition. It has been found that the color can be varied by changing the ratio of chromium to thiocyanate ions in the plating solution, a 1:4 chromium to thiocyanate ratio having a darker richer color than a 1:2 ratio. However, it has been found that the surface film formed during deposition is a more significant color determining factor. Removal of this surface film has been found to dramatically lighten the color of the chromium deposit. It is believed that the surface film consists at least in part of chromium compounds such as chromium hydroxide species.

SUMMARY OF THE INVENTION

Accordingly, the present invention provides a method for brightening an electroplated chromium deposit wherein the deposit is contacted with a solution having a constituent capable of forming complexes with chromium hydroxide species and of detaching the complexes so formed from the surface of an electroplated chromium deposit to thereby remove the surface film from the chromium. Preferably the solution is either an alkaline ferricyanide or a solution of sodium dichromate in sulfuric acid.

DESCRIPTION OF THE PREFERRED EMBODIMENTS

According to the present invention an electrodeposited chromium is brightened by contacting electrodeposited chromium with a solution capable of forming complexes with chromium hydroxide and of detaching the complexes formed from the surface of the electrodeposited chromium. The solution may be applied by spraying the solution onto the chromium deposit, or immersing the deposit in the solution, or by any other convenient method.

The invention will now be described with reference to the following examples:

EXAMPLE 1

A deposit of chromium was electroplated from an equilibrated aqueous solution prepared as described in the specification and United States patent application Ser. No. 913,973. The solution was comprised of:

Chromium (III) Sulphate: 0.1 M
Sodium thiocyanate: 0.4 M
Sodium perchlorate: 3 M
Glycine: 10 grams per liter
Boric acid: 60 grams per liter
Wetting agent (FC98)*: 0.1 gram per liter

*Product of the 3 M Corporation

The chromium deposit was electroplated from the above solution at a temperature of 40° C. and at a pH of 3.5.

The deposit was rinsed in water and then contacted with an alkaline ferricyanide solution for 10 seconds at 20° C. Significant brightening of the deposit was observed. The alkaline ferricyanide solution was comprised of:

30 grams per liter $K_3Fe(CN)_6$, and
10 grams per liter NaOH.

EXAMPLE 2

A deposit of chromium was made as in Example 1 rinsed in water and then immersed in an alkaline ferricyanide solution for 10 seconds at 20° C. comprised of:

20 grams per liter $K_3Fe(CN)_6$, and
5 grams per liter NaOH.

Similar brightening to that of Example 1 was observed.

EXAMPLE 3

A deposit of chromium was electroplated from an equilibrated solution prepared as described in the said application Ser. No. 913,973. The solution was comprised of:

Chromium (III) Sulphate: 0.1 M
Sodium thiocyanate: 0.4 M
Sodium chloride: 2 M
Glycine: 10 grams per liter
Boric acid: 60 grams per liter
Wetting agent (FC98)*: 0.1 gram per liter

*Product of 3 M Corporation.

The chromium deposit was electroplated from the above solution at a temperature of 50° C. and at a pH of 3.5.

The deposit was rinsed in water and then contacted with an alkaline ferricyanide solution for 10 seconds at 20° C. and significant brightening of the deposit was observed. The alkaline ferricyanide solution was comprised of:

30 grams per liter $K_3Fe(CN)_6$, and
5 grams per liter NaOH.

EXAMPLE 4

A deposit of chromium was plated from the equilibrated solution given in Example 3. The deposit was then rinsed in water and then contacted with a solution comprised of 0.2 M sodium dichromate and 0.5 M sulphuric acid for 10 seconds at a temperature of 20° C. Significant brightening of the deposit occurred.

In none of the above examples was any signficant attack or etching of the chromium deposit observed.

In each of the foregoing Examples the chromium deposit was rinsed in water after contacting with the brightening solution.

What we claim is:

1. A method of brightening an electroplated chromium deposit the surface of which contains chromium hydroxide species comprising contacting said deposit with an aqueous solution of an alkaline ferricyanide in the absence of an externally applied voltage to form complexes with said chromium hydroxide species and detaching the complexes so formed from the surface of an electroplated deposit.

2. The invention as defined in claim 1, in which the alkaline ferricyanide solution comprises $K_3Fe(CN)_6$.

3. The invention as defined in claim 1, in which the electroplated deposit is plated from a solution containing chromium (III) thiocyanate complexes.

4. The invention as defined in claim 1, in which said solution is applied to said deposit by immersion of the deposit.

5. The invention as defined in claim 1, wherein the solution is applied by spraying onto the deposit.

* * * * *